US010806981B2

(12) United States Patent
Givens

(10) Patent No.: US 10,806,981 B2
(45) Date of Patent: Oct. 20, 2020

(54) FORCE ISOLATING BASKETBALL SYSTEM

(71) Applicant: MEGA SLAM HOOPS, LLC, San Antonio, TX (US)

(72) Inventor: Jon Casey Givens, Katy, TX (US)

(73) Assignee: Mega Slam Hoops, LLC, San Antonio, TX (US)

( * ) Notice: Subject to any disclaimer, the term of this patent is extended or adjusted under 35 U.S.C. 154(b) by 0 days.

(21) Appl. No.: 15/840,356

(22) Filed: Dec. 13, 2017

(65) Prior Publication Data

US 2018/0272211 A1 Sep. 27, 2018

Related U.S. Application Data

(60) Provisional application No. 62/477,006, filed on Mar. 27, 2017.

(51) Int. Cl.
*A63B 63/08* (2006.01)

(52) U.S. Cl.
CPC ..... *A63B 63/083* (2013.01); *A63B 2225/30* (2013.01)

(58) Field of Classification Search
CPC ..... A63B 63/083
See application file for complete search history.

(56) References Cited

U.S. PATENT DOCUMENTS

| | | | | |
|---|---|---|---|---|
| 4,951,944 | A * | 8/1990 | Morgan | A63B 63/083 473/483 |
| 5,037,092 | A * | 8/1991 | Blackburn | A63B 63/083 473/481 |
| 5,114,141 | A * | 5/1992 | Mahoney | A63B 63/083 473/481 |
| 6,783,472 | B1 * | 8/2004 | Stanford | A63B 63/083 248/650 |
| 7,462,117 | B2 * | 12/2008 | White | A63B 63/083 473/481 |
| 2011/0207562 | A1 * | 8/2011 | Elpers | A63B 63/083 473/484 |

* cited by examiner

*Primary Examiner* — Jeffrey S Vanderveen
(74) *Attorney, Agent, or Firm* — Nolte Intellectual Property Law Group

(57) ABSTRACT

A basketball goal includes a stand, a backboard, a mounting assembly, and a rim. The backboard has a cutout. The mounting assembly includes a lower extension arm, a pair of upper extension arms, a mounting plate, and a mounting frame. Each upper extension arm has a first end coupled to the lower extension arm and a second end coupled to the backboard. A back surface of the mounting plate is affixed to an end of the lower extension arm. The mounting frame is affixed to the mounting plate and defines a channel into which a bottom edge of the backboard is fitted with the cutout around the mounting plate. The rim is affixed to the front surface of the mounting plate through the cutout in the backboard.

9 Claims, 5 Drawing Sheets

FORCE ISOLATING BASKETBALL SYSTEM

CROSS-REFERENCE TO RELATED APPLICATIONS

This application claims the priority of U.S. Provisional patent application having Ser. No. 62/477,006, which was filed Mar. 27, 2017. The aforementioned patent application is hereby incorporated by reference in its entirety into the present application to the extent consistent with the present application.

BACKGROUND

Basketball goals typically have a rim mounted to a backboard. It has become quite common for players to leap and "dunk" a basketball directly through the rim rather than shoot from the floor. Players occasionally grab the rim and hold onto it. This sometimes leads to structural failure of the rim, the backboard, or both. Such structural failures can require significant downtime in the game or practice as the rim and/or the backboard is replaced. Some clean-up is also occasionally warranted, especially when the backboard shatters and the pieces fall onto the court.

There have been several attempts to mitigate these types of occurrences. For example, some basketball goals include what are known as "breakaway rims". These rims deform in a controlled fashion to absorb energy and keep it from being transferred to the backboard. They then return to their original shape and position afterwards so that play can quickly resume. However, the art is always accepting of further advances relative to this problem and so the presently disclosed technique will be well received.

SUMMARY

Embodiments of the disclosure provides a basketball goal. The basketball goal includes a stand, a backboard, a mounting assembly, and a rim. The backboard has a cutout. The mounting assembly includes a lower extension arm, a pair of upper extension arms, a mounting plate, and a mounting frame. Each upper extension arm has a first end coupled to the lower extension arm and a second end coupled to the backboard. The mounting plate has a front surface and a back surface. The back surface of the mounting plate is affixed to an end of the lower extension arm. The mounting frame is affixed to the mounting plate and defines a channel into which a bottom edge of the backboard is fitted with the cutout around the mounting plate. A front surface of the backboard is flush with the front surface of the mounting plate. The rim is affixed to the front surface of the mounting plate through the cutout in the backboard.

Embodiments of the disclosure further provides a mounting assembly for a basketball goal. The mounting assembly includes a lower extension arm, a first upper extension arm, a second upper extension arm, a mounting plate, and a mounting frame. The first upper extension arm has a first end and a second end. The first end of the first upper extension arm is coupled to the lower extension arm, and the second end of the first upper extension arm extends to a first side of the mounting assembly. The second upper extension arm has a first end and a second end. The first end of the second upper extension arm is coupled to the lower extension arm, and the second end of the second upper extension arm extends to a second side of the mounting assembly. The mounting plate has a front surface and a back surface. The back surface of the mounting plate is affixed to an end of the lower extension arm. The front surface of the mounting plate is spaced from the back surface such that the front surface is flush with a backboard when the backboard is mounted. The mounting frame is affixed to the mounting plate with the mounting frame defining a channel into which the backboard is fitted when the backboard is mounted.

Embodiments of the disclosure further provides a basketball goal. The basketball goal includes a stand having a base, a mounting assembly coupled to the stand, a backboard, and a hinge coupled to the base. The mounting assembly includes a lower extension arm, a first upper extension arm, a second upper extension arm, a mounting plate, and a mounting frame. The first upper extension arm has a first end and a second end. The first end of the first upper extension arm is coupled to the lower extension arm, and the second end of the first upper extension arm extends to a first side of the mounting assembly. The second upper extension arm has a first end and a second end. The first end of the second upper extension arm is coupled to the lower extension arm, and the second end of the second upper extension arm extends to a second side of the mounting assembly. The mounting plate has a front surface and a back surface. The back surface of the mounting plate is affixed to an end of the lower extension arm. The mounting frame is affixed to the mounting plate and defines a channel. The backboard has a bottom edge fitted in the channel of the mounting frame. The backboard defines a cutout positioned parallel to the front surface of the mounting plate. The backboard includes a first side and a second side. The first side is coupled to the second end of the first upper extension arm on the first side of the mounting assembly. The second side is coupled to the second end of the second upper extension arm on the second side of the mounting assembly. The hinge is coupled to the base such that the stand and the lower extension arm may be tilted to permit the backboard to slide into the mounting frame.

Embodiments of the disclosure further provides a method of mounting a backboard. The method includes affixing a lower extension arm to a stand. The method also includes coupling a pair of upper extension arms to the lower extension arm. Each upper extension arm has a first end coupled to the lower extension arm and a second end coupled to the backboard. The method further includes affixing a back surface of a mounting plate to an end of the lower extension arm and affixing a mounting frame to the mounting plate. The method also includes sliding the backboard into the mounting frame with a cutout in the backboard mating with a front surface of the mounting plate. The method further includes affixing a rim to the front surface of the mounting plate through the cutout in the backboard.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

Figure 1:
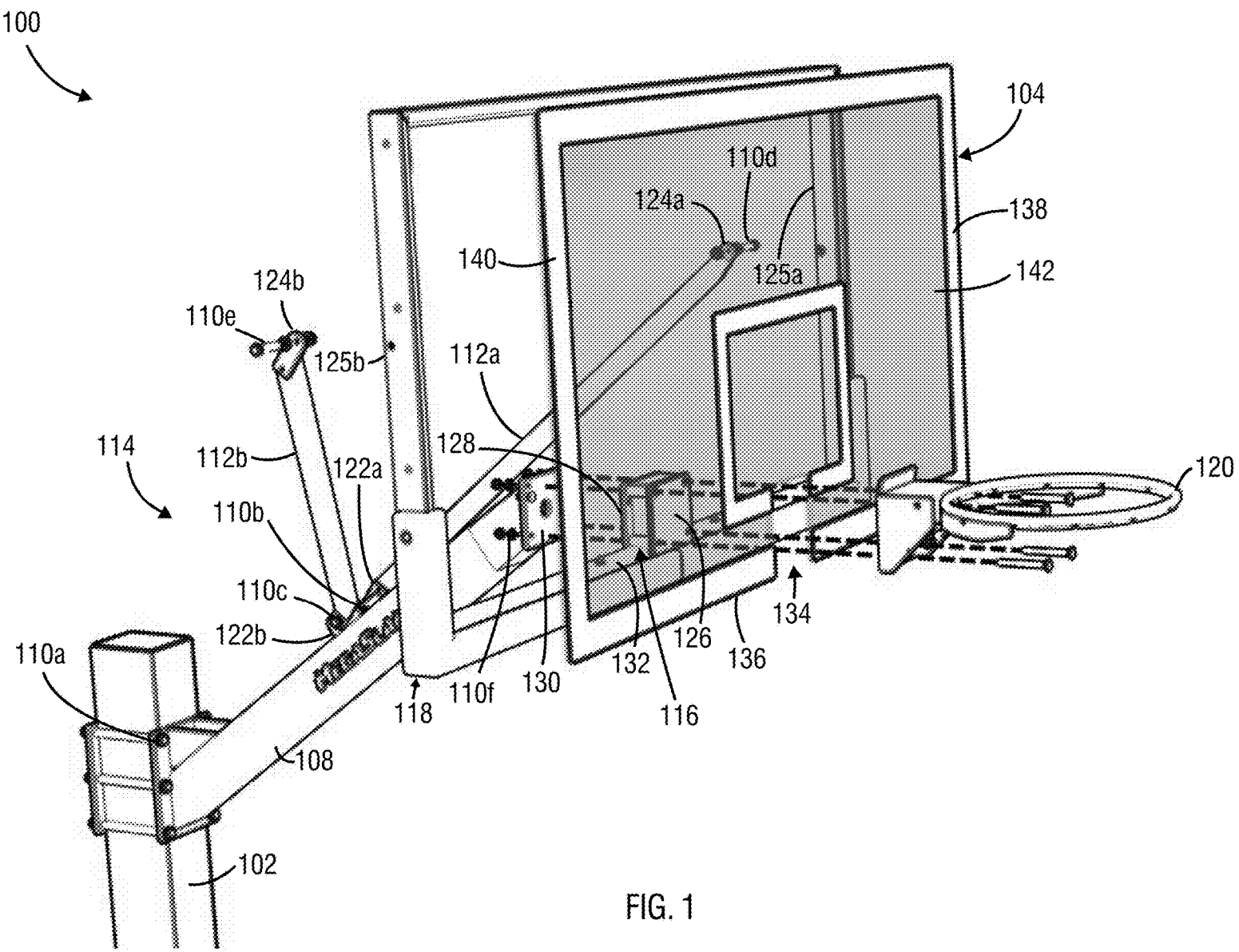
FIG. 1 illustrates a basketball goal having a stand, a backboard, a mounting assembly, and a rim in accordance with one particular embodiment of the invention in a perspective, assembled view from the front of the basketball goal with the backboard exploded from the mounting frame to better reveal a cutout.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not, be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates one particular embodiment of a basketball goal 100 in accordance with one particular embodiment of the invention in a perspective, assembled view from the front of the basketball goal 100 with a backboard 104 exploded from a mounting frame 118 to better reveal a cutout 134. This particular embodiment comprises a stand 102, the backboard 104 having a cutout 134, a mounting assembly 114, and a rim 120. The mounting assembly 114 comprises a lower extension arm 108, a plurality of fasteners 110*a*-110*f* (e.g., bolts and brackets in the illustrated embodiment), a pair of upper extension arms 112*a*, 112*b*, a mounting plate 116, and a mounting frame 118.

Figure 2:
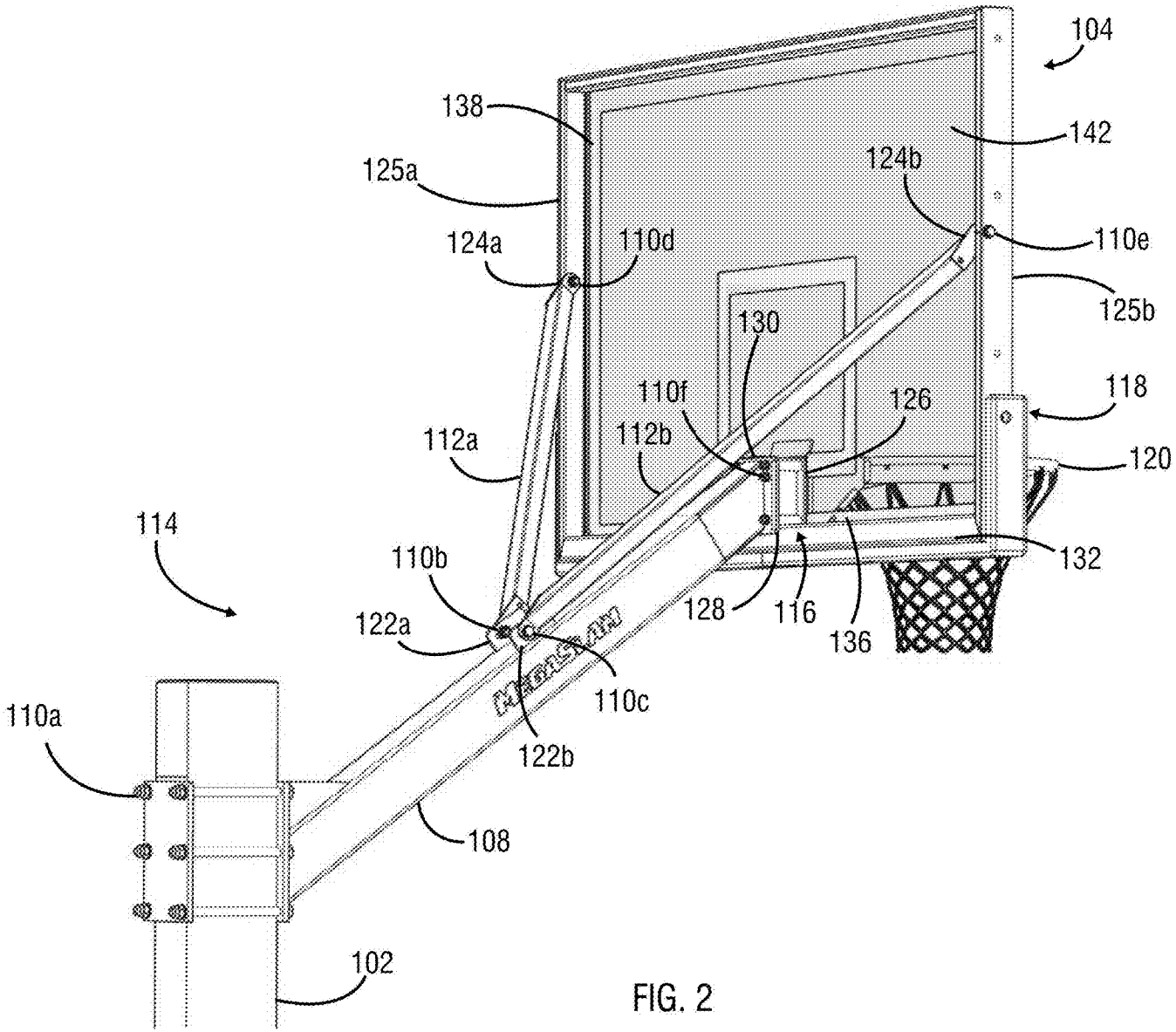
FIG. 2 illustrates the basketball goal of FIG. 1 from a perspective, assembled view from the rear of the basketball goal.

Referring now to FIG. 2, with continued reference to FIG. 1, FIG. 2 illustrates a perspective, assembled view from the rear of the goal. The mounting assembly 114 is coupled to the stand 102 at a fixed height using a plurality of fasteners 110*a*. The mounting assembly 114 includes the pair of upper extension arms 112*a*, 112*b* coupled to the lower extension arm 108 using the plurality of fasteners 110*b*, 110*c*. The pair of upper extension arms 112*a*, 112*b* are coupled to the lower extension arm 108 at first ends 122*a*, 122*b* via the plurality of fasteners 110*b*, 110*c*. The pair of upper extension arms 112*a*, 112*b* are coupled to the backboard 104 at second ends 124*a*, 124*b* via the plurality of fasteners 110*d*, 110*e*. In other embodiments, the mounting assembly 114 may include one or more arms than the two upper extension arms 112*a*, 112*b*.

The first upper extension arm 112*a* has the first end 122*a* coupled to the lower extension arm 108 via the plurality of fasteners 110*b*. The first upper extension arm 112*a* has the second end 124*a*, which extends to a first side 125*a* of the mounting assembly 114. The second upper extension arm 112*b* has the first end 122*b* coupled to the lower extension arm 108 via the plurality of fasteners 110*c*. The second upper extension arm 112*b* has the second end 124*b*, which extends to a second side 125*b* of the mounting assembly 114. In alternative embodiments, the plurality of fasteners 110*b*, 110*c* may be omitted and the pair of upper extension arms 112*a*, 112*b* may be coupled to the lower extension arm 108 through welding or any other suitable technique known to the art.

The mounting plate 116 has a front surface 126, best shown in FIG. 2, and a back surface 128, best shown in FIG. 1. The back surface 128 of the mounting plate 116 is affixed to an end 130 of the lower extension arm 108 using the plurality of fasteners 110*f*. Other embodiments may affix the mounting plate 116 to the end 130 of the lower extension arm 108 in other ways, however, using any suitable technique known to the art. The mounting frame 118 is affixed to the mounting plate 116. The mounting frame 118 defines a channel 132 into which a bottom edge 136 of the backboard 104 is fitted with the cutout 134 around the mounting plate 116.

The backboard 104 has a first side 138 and a second side 140. The first side 138 of the backboard 104 is coupled to the second end 124*a* of the first upper extension arm 112*a* on the first side 125*a* of the mounting assembly 114. The second side 140 of the backboard 104 is coupled to the second end 124*b* of the second upper extension arm 112*b* on the second side 125*b* of the mounting assembly 114. In alternative embodiments, the second ends 124*a*, 124*b* of the first upper extension arms 112*a*, 112*b* may be coupled to the backboard 104 on different ends of the same side of the backboard 104.

A front surface 142 of the backboard 104 is flush with the front surface 126 of the mounting plate 116. The rim 120 is affixed to the front surface 126 of the mounting plate 116 through the cutout 134 in the backboard 104. The backboard 104 may be made of a material such as glass, tempered glass, plexiglass, or polycarbonate.

Figure 3:
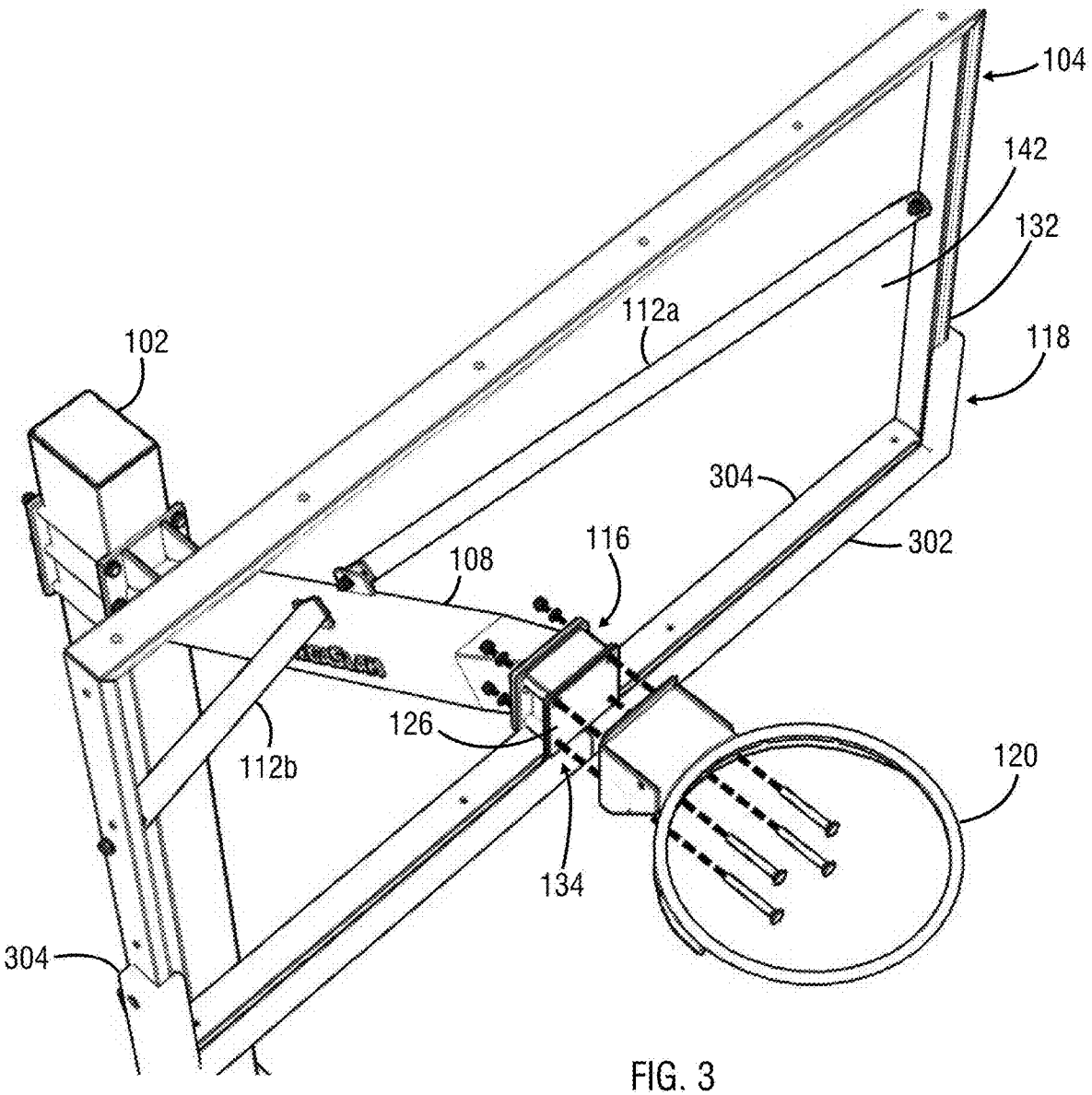
FIG. 3 illustrates the relationship of a mounting plate, a mounting frame, a backboard, and a rim in the basketball goal of FIG. 1 from the front of the basketball goal.

Referring now to FIG. 3, with continued reference to FIG. 1, FIG. 3 illustrates the relationship of the mounting plate 116, the mounting frame 118, the backboard 104, and the rim 120. The mounting frame 118 is affixed to the mounting plate 116. The mounting frame 118 has a front lip 302 and a back lip 304. The channel 132 extends between the front lip 302 and the back lip 304. The cutout 134 in the backboard 104 is matched to a shape and dimensions of the mounting plate 116. The front surface 142 of the backboard 104 is flush with the front surface 126 of the mounting plate 118. The rim 120 is affixed to the front surface 126 of the mounting plate 116 through the cutout 134 in the backboard 104.

Figure 4A:
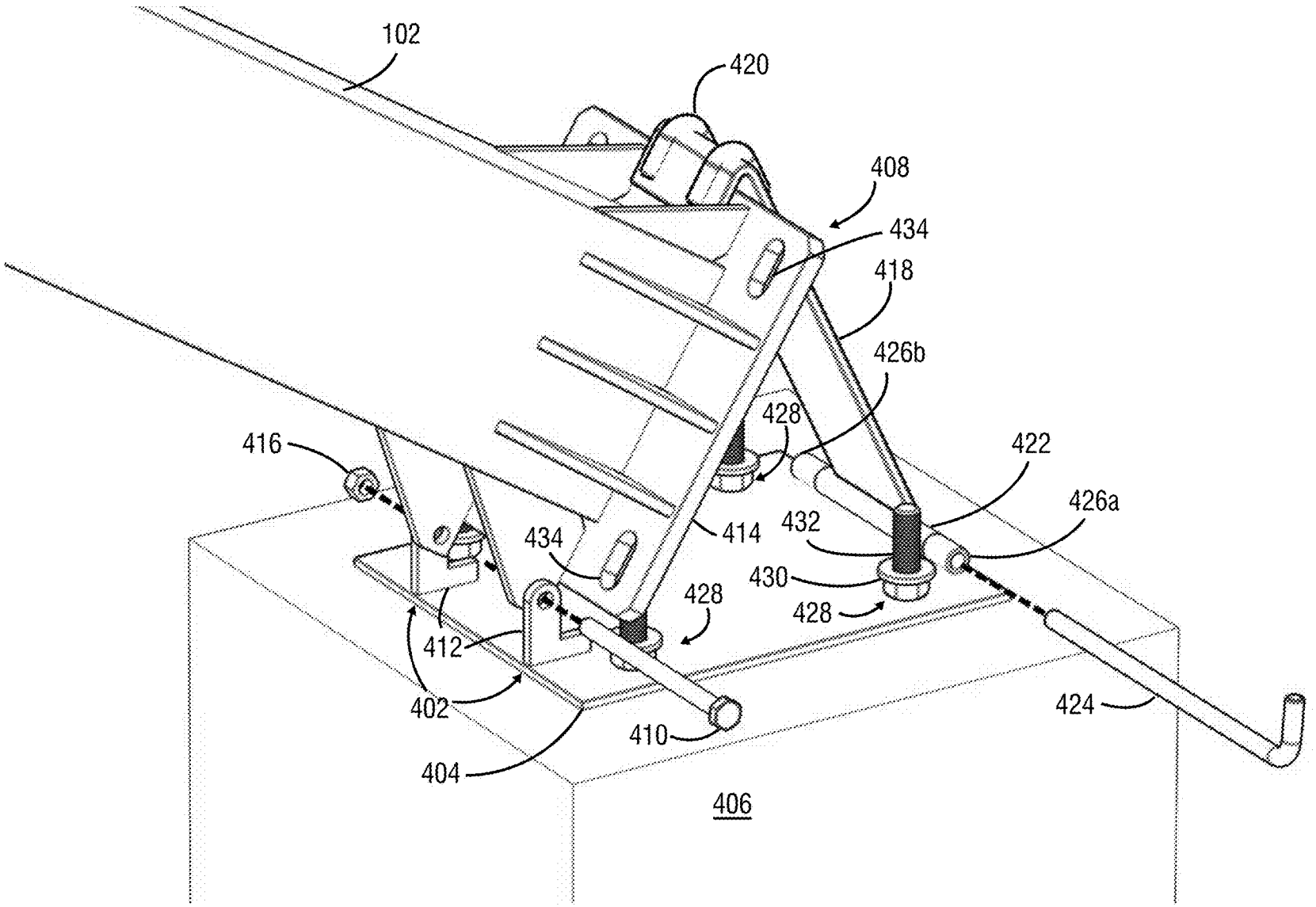
FIG. 4A depicts the tilting mechanism of the stand of FIG. 1 as may be found in some embodiments and omitted in others.

Referring now to FIG. 4A, with continued reference to FIG. 1, the illustrated embodiment includes a hinge 402 by which the basketball goal 100 may be tilted. The hinge 402 is disposed on an anchor plate 404, which is anchored to the ground through a concrete mount 406. The hinge 402 is coupled to a base 408 of the stand 102. The hinge 402 is defined by a hinge bolt 410 that extends through hinge leaves 412 coupled to a base plate 414 and the base 408 of the stand 102. Rotation on the hinge 402 defined by the hinge bolt 410 secured by a hinge nut 416 may allow for tilting the stand 102.

Figure 4B:
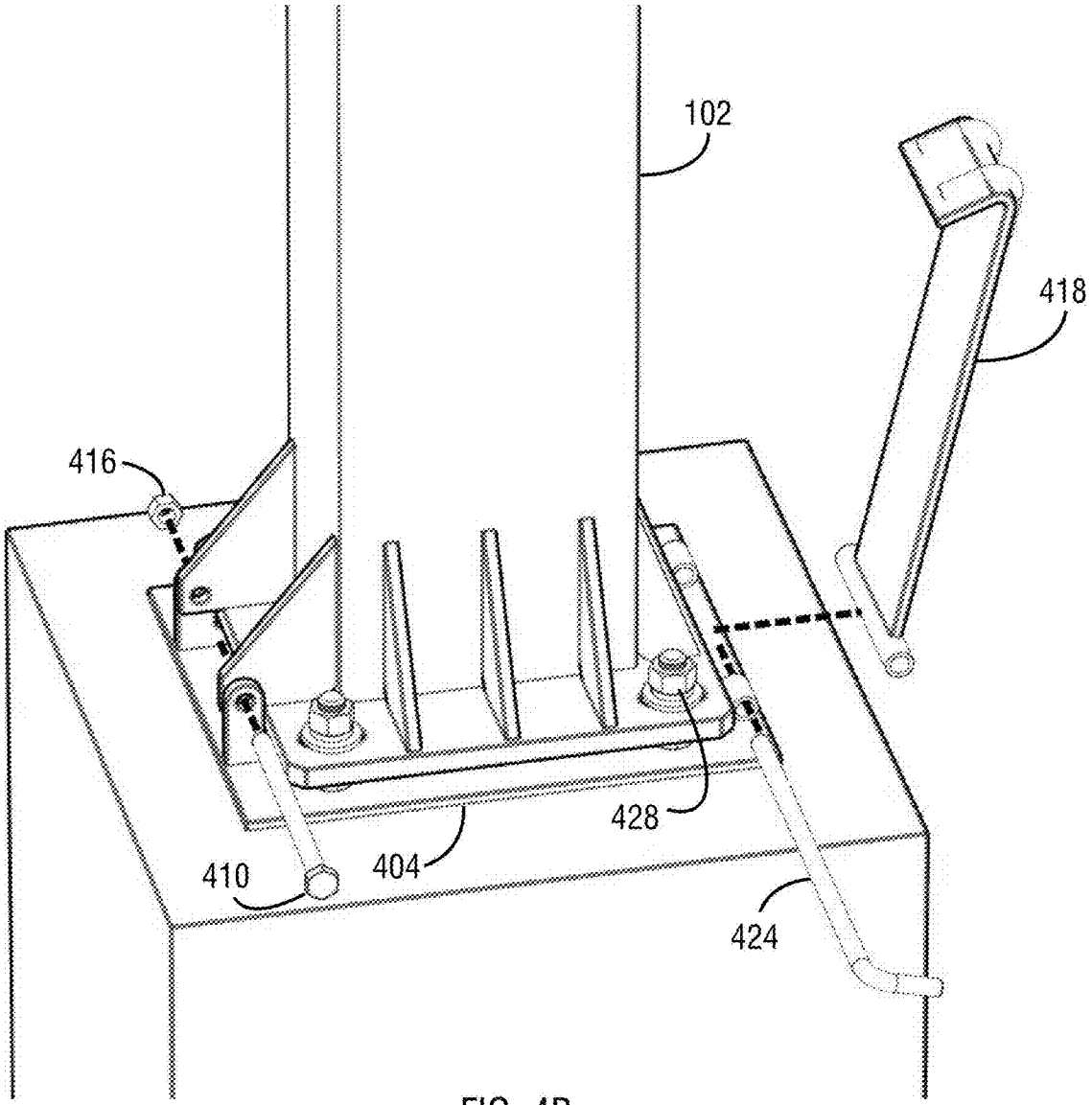
FIG. 4B illustrates a perspective, assembled view of the stand of FIG. 1 in a vertical position with the installation brace removed.

As shown in FIG. 4A, the stand 102 is tilted to lower the mounting frame 118 to facilitate fitting the bottom edge 136 of the backboard 104 into the mounting frame 118. An installation brace 418 is configured to provide stability of the stand 102 while in a tilted position. The installation brace 418 has a first end 420 removably coupled to the base plate 414. The installation brace 418 has a second end 422 removably coupled to the anchor plate 404. A brace pin 424 extends through the second end 422 of the installation brace 418 and tubes 426*a*, 426*b* disposed on the anchor plate 404. The installation brace 418 and the brace pin 424 are removed when the stand 102 is vertical (best shown in FIG. 4B).

A plurality of bolts 428 are coupled to the base plate 414 by which the basketball goal 100 is secured to the concrete mount 406. The plurality of bolts 428 are secured by their heads 430 to the anchor plate 404. When the stand 102 is vertical (best shown in FIG. 4B), threaded stems 432 of the plurality of bolts 428 fit through openings 434 in the base plate 414, where the threaded stems 432 can then be secured by bolts 428 to the base plate 414. Rotation of the head 430 of the plurality of bolts 428 may allow for leveling the stand 102 after the stand 102 is returned to a vertical position. In alternative embodiments, the hinge 402, the plurality of bolts 428, or both may be omitted.

Accordingly, once the basketball goal 100 is installed, the installation may be tilted on the hinge 402 to facilitate fitting the backboard 104 into the channel 132 of the mounting frame 118. The installation brace 418 may be used to hold the installation in the titled position and stabilize it there while the fitting is performed. However, the hinge 402 may be omitted in some embodiments. For example, at some locations there may be some means, such as a scissors lift, by which the backboard can be lifted high enough to fit into the mounting frame 118. In such situations, the hinge 402 would be superfluous and, thus, omitted.

A method for mounting a backboard 104 includes affixing a lower extension arm 108 to a stand 102. The method also includes coupling a pair of upper extension arms 112*a*, 112*b* to the lower extension arm 108 with each upper extension arm 112*a*, 112*b* having a first end 122*a*, 122*b* coupled to the lower extension arm 108 and a second end 124*a*, 124*b* coupled to the backboard 104 via a plurality of fasteners 110*d*, 110*e*. The method further includes affixing a back surface 128 of a mounting plate 116 to an end 130 of the lower extension arm 108. The method also includes affixing a mounting frame 118 to the mounting plate 116. The method further includes sliding the backboard 104 into the mounting frame 118 with a cutout 134 in the backboard 104 mating with a front surface 126 of the mounting plate 116. The method also includes affixing a rim 120 to the front surface 126 of the mounting plate 116 through the cutout 134 in the backboard 104. The method further includes tilting the stand 102 to lower the mounting frame 118 to facilitate sliding the backboard 104 into the mounting frame 118, a hinge 402 being coupled to a base 408 of the stand 102. The method also includes leveling the stand 102 via a plurality of bolts 428 coupled to a base plate 414 of the base 408 when the stand 102 is in a vertical position.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A basketball goal comprising:

a stand;

a backboard having a cutout;

a mounting assembly, coupled to the stand, to hold the backboard and isolate rim forces from the backboard while the basketball goal is playable at a fixed height, the mounting assembly comprising:

a lower extension arm to support a rim in force isolation from the backboard;

a mounting plate having a front surface, a back surface, and a top edge, the back surface of the mounting plate directly affixed to an end of the lower extension arm, the front surface of the mounting plate to accept attachment of the rim;

a weight bearing mounting frame to support the backboard, the mounting frame affixed to the mounting plate and defining a squared off channel, having a front lip and a back lip, into which a bottom edge and portions of two side edges of the backboard are fitted with the cutout around the mounting plate, and a front surface of the backboard, after the fitting, being flush with the front surface of the mounting plate, the fitting of the bottom edge of the backboard provided by sliding the backboard into the squared off channel between the front lip and the back lip such that the backboard rests within the squared off channel, the backboard isolated, via the cutout, from forces applied to the rim attached to the front surface of the mounting plate; and a pair of upper extension arms, each upper extension arm having a first end directly coupled to the lower extension arm and a second end coupled to the backboard after the fitting, wherein upon installation, the rim is directly affixed to the front surface of the mounting plate at the cutout in the backboard; and a hinge coupled to a base of the stand such that the stand may be tilted to lower the mounting frame to facilitate sliding the of the backboard into the weight bearing mounting frame.

2. The basketball goal of claim 1, wherein the cutout in the backboard is matched to a shape and dimensions of the mounting plate to surround the mounting plate.

3. The basketball goal of claim 1, further comprising a plurality of bolts coupled to a base plate of the base, the plurality of bolts configured to level the stand when the stand is oriented in a vertical position.

4. A mounting assembly for a basketball goal to hold a backboard and isolate rim forces from the backboard, the mounting assembly comprising:

a lower extension arm to support a rim in force isolation from the backboard;

a mounting plate having a front surface, a back surface, and a top edge, the back surface of the mounting plate directly affixed to an end of the lower extension arm and the front surface spaced from the back surface such that the front surface is flush with a front surface of a backboard when the backboard is mounted;

a weight bearing mounting frame affixed to the mounting plate to support the backboard in force isolation from the rim, the mounting frame defining a squared off channel, having a front lip and a back lip, into which a bottom edge and portions of two side edges of the backboard are fitted, a cutout of the backboard around the mounting plate when the backboard is mounted, the fitting of the bottom edge of the backboard provided by sliding the backboard into the squared off channel between the front lip and the back lip such that the backboard rests within the squared off channel, the backboard isolated, via the cutout, from forces applied to the rim attached to the front surface of the mounting plate;

a first upper extension arm having a first end and a second end, the first end of the first upper extension arm being directly coupled to the lower extension arm, the second end of the first upper extension arm extending to a first side of the mounting assembly; and a second upper extension arm having a first end and a second end, the first end of the second upper extension arm directly coupled to the lower extension arm, the second end of the second upper extension arm extending to a second side of the mounting assembly.

5. A basketball goal comprising:

a stand having a base;

a mounting assembly, coupled to the stand, to hold the backboard and isolate rim forces from the backboard while the basketball goal is playable at a fixed height, the mounting assembly comprising:

a lower extension arm to support a rim in force isolation from the backboard;

a first upper extension arm having a first end and a second end, the first end of the first upper extension arm being directly coupled to the lower extension arm, the second end of the first upper extension arm extending to a first side of the mounting assembly;

a second upper extension arm having a first end and a second end, the first end of the second upper extension arm directly coupled to the lower extension arm, the second end of the second upper extension arm extending to a second side of the mounting assembly;

a mounting plate having a front surface and a back surface, the back surface of the mounting plate directly affixed to an end of the lower extension arm, the front surface of the mounting plate to accept attachment of the rim; and a weight bearing mounting frame affixed to the mounting plate, the mounting frame defining a squared off channel formed between a front lip and a back lip of the mounting frame;

a backboard having a bottom edge fitted into the channel of the mounting frame, the channel of the mounting frame to support the backboard while in use, the backboard defining a cutout positioned parallel to the front surface of the mounting plate, wherein upon fitting the backboard by sliding the backboard into the squared off channel, a front surface of the mounting plate remains flush with a front surface of the backboard, and, after fitting, the backboard comprising:

a first side coupled to the second end of the first upper extension arm on the first side of the mounting assembly; and a second side coupled the second end of the second upper extension arm on the second side of the mounting assembly;

an anchor plate anchored to the ground through a concrete mount; and a hinge disposed on the anchor plate, coupled to the base with a hinge bolt which extends through hinge leaves, such that the stand and the lower extension arm may be tilted to permit the backboard to slide into the weight bearing mounting frame to accomplish the fitting.

6. The basketball goal of claim 5, wherein a rim is directly coupled to the front surface of the mounting plate through at the cutout in the backboard.

7. The basketball goal of claim 5, further comprising a plurality of bolts coupled to a base plate of the base, the plurality of bolts configured to level the stand when the stand is oriented in a vertical position.

8. A method of mounting a backboard, the method comprising:

attaching a mounting assembly to a stand for playable use of the backboard at a fixed height, the attaching including:

affixing a lower extension arm to the stand;

directly affixing a back surface of a mounting plate to an end of the lower extension arm; and affixing a weight bearing mounting frame to the mounting plate, the weight bearing mounting frame to support the backboard in force isolation from a rim, the weight bearing mounting frame providing a squared off channel between a front lip and a back lip to accept insertion of a bottom edge and two side edges of the backboard;

sliding the backboard into the squared off channel between a front lip and a back lip of the weight bearing mounting frame, a cutout in the backboard surrounding a front surface of the mounting plate;

coupling a pair of upper extension arms to the lower extension arm, each upper extension arm having a first end directly coupled to the lower extension arm and a second end being coupled to the backboard;

directly affixing the rim to the front surface of the mounting plate at the cutout in the backboard, the backboard isolated, via the cutout, from forces applied to the rim attached to the front surface of the mounting plate; and tilting the stand via a hinge to a base of the stand such that the stand may be lowered to angle the mounting frame to facilitate fitting of the bottom edge and two side edges of the backboard while sliding the backboard into the weight bearing mounting frame.

9. The method of claim 8, further comprising leveling the stand via a plurality of bolts coupled to a base plate of the base when the stand is oriented in a vertical position.

* * * * *